US005821960A

United States Patent [19]

Mitani

[11] Patent Number: 5,821,960

[45] Date of Patent: Oct. 13, 1998

[54] INK JET RECORDING HEAD HAVING FIRST AND SECOND CONNECTION LINES

[75] Inventor: Masao Mitani, Hitachinaka, Japan

[73] Assignee: Hitachi Koki Co., Ltd., Tokyo, Japan

[21] Appl. No.: 715,609

[22] Filed: Sep. 18, 1996

[30] Foreign Application Priority Data

Sep. 18, 1995 [JP] Japan ..... 7-238246
Dec. 22, 1995 [JP] Japan ..... 7-334802

[51] Int. Cl.[6] ..... B41J 2/05

[52] U.S. Cl. ..... 347/58; 347/59; 347/62

[58] Field of Search ..... 347/57, 58, 59, 347/43, 42, 47, 20, 1, 62

[56] References Cited

U.S. PATENT DOCUMENTS 5,463,412 10/1995 Matsuda ..... 347/43

FOREIGN PATENT DOCUMENTS 489622 2/1973 Japan .
5451837 4/1979 Japan .
401259957 10/1989 Japan ..... 347/62
671888 3/1994 Japan .

OTHER PUBLICATIONS

R. Askeland et al.; "The Second–Generation Thermal InkJet Structure"; Hewlett–Packard Journal, Aug. 1988, pp. 28–32.
Nikkei Mechanical, Dec. 28, 1992, pp. 58–63.

*Primary Examiner*—Benjamin R. Fuller
*Assistant Examiner*—Juanita Dionne Stephens
*Attorney, Agent, or Firm*—Whitham, Curtis & Whitham

[57] ABSTRACT

To generate an amount of heat uniformly in respective heaters which are selectively driven to eject ink droplets from the corresponding nozzles, a bypass common line is connected to a common conductor line with at least one connection conductor line. The heaters are connected between an LSI driver circuit and the common conductor line. The common conductor line and the connection conductor lines are made from nickel and the bypass common line is made from aluminum. Alternatively, the common conductor line may be of a three-lay structure having a first layer of a thin-film aluminum, a second layer of a Ta—Si—O alloy thin-film deposited to cover the first layer, and a third layer of a nickel thin-film deposited on the second layer.

20 Claims, 9 Drawing Sheets

15
16
17
13
6
18
11
7
5
14
51

INK JET RECORDING HEAD HAVING FIRST AND SECOND CONNECTION LINES

BACKGROUND OF THE INVENTION

1. Field of the Invention

The present invention relates to a recording device of the type using heat energy for ejecting ink droplets toward a recording medium.

2. Description of the Related Art

Japanese Laid-Open Patent Publication (hereinafter referred to as "OPI publication") Nos. SHO-48-9622 and SHO-54-51837 describe an ink jet recording device wherein a portion of ink in an ink chamber is rapidly vaporized to form an expanding bubble. The expansion of the bubble ejects an ink droplet from an orifice connected with the ink chamber. As described in the August 1988 edition of Hewlett Packard Journal and the Dec. 28, 1992 edition of Nikkei Mechanical (see page 58), the simplest method for rapidly heating the portion of the ink is to apply an energizing pulse of voltage to a heater. The heater is constructed from a thin-film resistor and thin-film conductors covered with an anti-corrosion layer for protecting the resistor from corrosion damage. The anti-corrosion layer is additionally covered with one or two anti-cavitation layers for protecting the anti-corrosion layer against cavitation damage.

OPI publication No. HEI-6-71888 describes a protection-layerless heater formed from a Ta—Si—SiO alloy thin-film resistor and nickel thin-film conductors. Absence of protection layers to the heater greatly improves sufficiency of heat transmission from the heater to the ink. This allows great increases in print speed, i.e., in frequency at which ink droplets can be ejected. A print head wherein such heaters are used can be more simply produced.

Ink droplets can be ejected by applying only small amounts of energy to the heaters. The area surrounding the heaters will not be heated up by a small amount of energy applied. Therefore, the LSI chip for driving the heaters can be formed near the heaters without fear of the LSI being damaged by overheating. A monolithic LSI head with a simple structure can thus be produced wherein the LSI chip for driving the heaters is positioned near the heaters. Using this new technology, an on-demand type ink jet printer head can be produced wherein many nozzles are arranged two dimensionally at a high density. Also, the number of control wires is greatly reduced. Therefore, mounting of the printer head can be simplified.

As the number of the nozzles aligned increases, the length of the common thin-film conductor becomes longer. Then, the resistance value of the conductor is not negligibly small relative to that of the thin-film heater resistor.

Especially, it is a problem when a nickel thin-film conductor that is large in resistivity is used as the common thin-film conductor, because the local voltages along the thin-film heater resistor differ from place to place and thus the heat amount generated in respective positions on the resistor differs.

In the circuit configuration shown in FIG. 5, each of the resistance values R1 through Rn of a 400 dpi (dots per inch) thin-film heater resistors 52 is approximately 200 Ω when Ta—Si—SiO thin-film resistor is used, the resistance value r of the common thin-film conductor line 54 in between adjacent heater resistors 52 is approximately 0.08 Ω when 1 μm thick and 80 μm wide nickel thin-film conductor is used, and the resistance value a of the thin-film conductor for connecting corresponding driving device 56 is approximately 0.01 Ω when 1 μm thick and 200 μm wide aluminum thin-film conductor is use.

For 128 thin-film heater resistors 52, i.e., n=128, electric power W1 applied to the resistor R1 having a smallest resistance value is $5\times10^{-3}V^2$ and electric power Wn applied to the resistor Rn having a largest resistance value is $4.47\times10^{-3}V^2$. If the heater resistor Rn is heated up to a temperature of 300° C. necessary for ejecting ink droplets, the heater resistor R1 is heated up to about a temperature of 333° C. Under such a heating condition, the heater resistors are not damaged, and a continuous use thereof is possible.

However, when the number of the nozzles is increased to 256, i.e., n=256, the electric power W1 applied to the resistor R1 is $5\times10^{-3}V^2$ and electric power Wn applied to the resistor Rn is $4.02\times10^{-3}V^2$. If the heater resistor Rn is heated up to a temperature of 300° C., the heater resistor R1 is heated up to about a temperature of 368° C., to shorten the service life of the heater resistor R1. Therefore, the circuit is not practically usable under such a condition.

SUMMARY OF THE INVENTION

It is an object of the present invention to resolve the above-described problems and to provide an ink jet recording head having a plurality of heater resistors which uniformly generates heat along the lengthwise direction of the head.

To achieve the above and other objects, there is provided, in accordance with one aspect of the present invention, an ink jet recording head including a plurality of heaters formed on the surface of a silicon substrate and having a plurality of thin-film resistors and a plurality of thin-film conductors provided to respective ones of the plurality of thin-film resistors individually. A driver circuit is formed in the surface of the silicon substrate and connected to the plurality of thin-film resistors through the plurality of thin-film conductors, respectively. The driver circuit selectively drives the plurality of heaters. A plurality of partition walls are formed on the surface of the silicon substrate and define a plurality of individual ink channels corresponding to respective ones of the plurality of heaters individually. An orifice plate is disposed on the plurality of partition walls and formed with a plurality of orifices corresponding to respective ones of the plurality of individual ink channels individually. A common ink channel is in fluid communication with the plurality of individual ink channels. A first connection line commonly connects the plurality of thin-film resistors to a common terminal. The first connection line has a resistance value per a unit length, wherein the plurality of heaters and the first connection line are formed in a first aide of the common ink channel. A bypass common line is provided in a second side opposite the first side with respect to the common ink channel. The bypass common line has a resistance value per a unit length that is lower than the resistance value of the first connection line. At least one second connection line connects the bypass common line to the first connection line.

According to another aspect of the present invention, the plurality of heaters and the first connection line are formed at one side of the common ink channel remote from the driver circuit, and the bypass common line is provided in a vicinity of the driver circuit.

The second connection line has a resistance value per a unit of length that is substantially equal to the resistance value of the first connection line. Preferably, the first connection line and the second connection lines are made from nickel, and the bypass common line is made from aluminum. The plurality of thin-film resistors are made from a Ta—Si—SiO alloy.

The common ink channel may be divided into a predetermined number of common ink channel segments. The plurality of heaters are also divided into a predetermined number of groups corresponding to the predetermined number of common ink channel segments. Each of the predetermined number of groups contains a predetermined number of heaters, wherein individual ink channels corresponding to the predetermined number of heaters contained in each of the predetermined number of groups are in fluid communication with a corresponding one of the predetermined number of common ink channel segments. The second connection line extends between adjacent two common ink channel segments.

The predetermined number of heaters contained in each of the predetermined number of groups have resistance values substantially equal to one another when the plurality of heaters are divided into a first number. The predetermined number of heaters contained in each of the predetermined number of groups have such resistance values that the predetermined number of heaters generate an amount of heat substantially equal to one another when the plurality of heaters are divided into a second number. The second number is greater than the first number.

According to still another aspect of the present invention, the connection line commonly connecting the plurality of thin-film resistors to a common terminal is of a three-layer structure comprising an aluminum thin-film layer, a Ta—Si—O alloy thin-film layer deposited to cover the aluminum thin-film layer, and a nickel thin-film layer deposited on the Ta—Si—O alloy thin-film layer.

The Ta—Si—O alloy thin-film layer may extend below the plurality of heaters.

BRIEF DESCRIPTION OF THE DRAWINGS

The above and other objects, features and advantages of the invention will become more apparent from reading the following description of the preferred embodiments taken in connection with the accompanying drawings in which:

FIG. 7(*b*) is a plan view showing the ink jet recording head according to the second embodiment of the present invention as viewed from the side of an orifice plate side;

FIG. 7(*c*) is a plan view showing the ink jet recording head according to the second embodiment of the present invention in which the orifice plate is removed from the view shown in FIG. 7(*b*);

FIG. 7(*d*) is a plan view showing the ink jet recording head according to the second embodiment of the present invention in which partition walls are removed from the view shown In FIG. 7(*c*);

DETAILED DESCRIPTION OF THE PREFERRED EMBODIMENTS

Ink jet print heads according to preferred embodiments of the present invention will be described while referring to the accompanying drawings.

Figure 2:
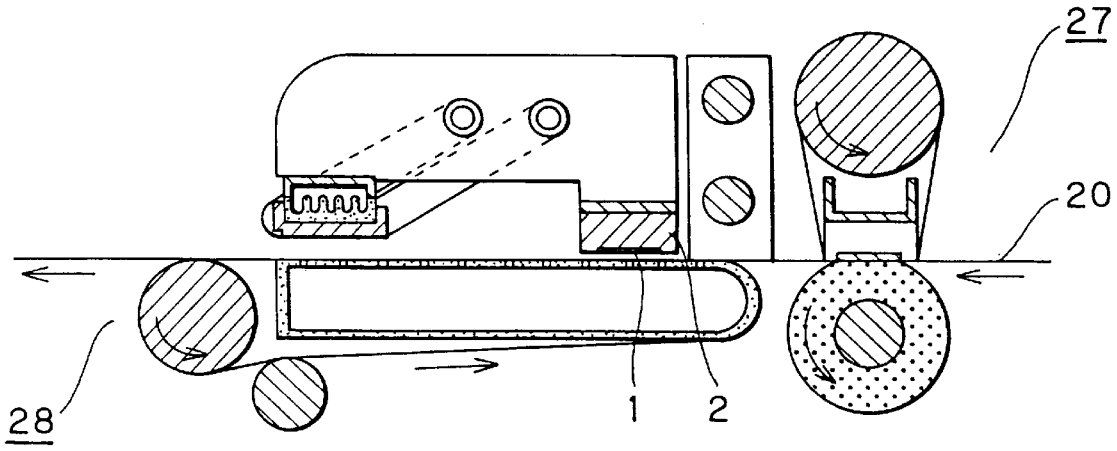
FIG. 2 is a cross-sectional view showing an ink jet printer to which various embodiments of the present invention are applied.
Figure 3:
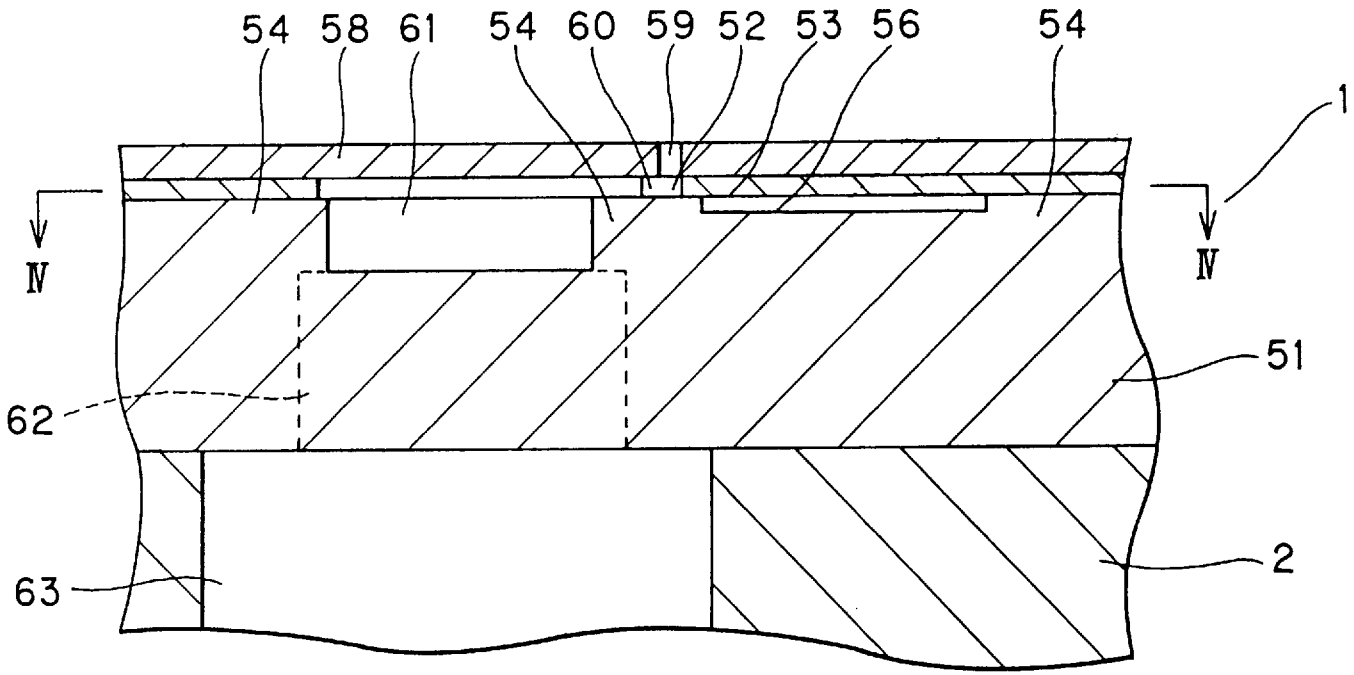
FIG. 3 is a cross-sectional view showing an ink jet recording head used in the ink jet printer shown in FIG. 2.
Figure 4:
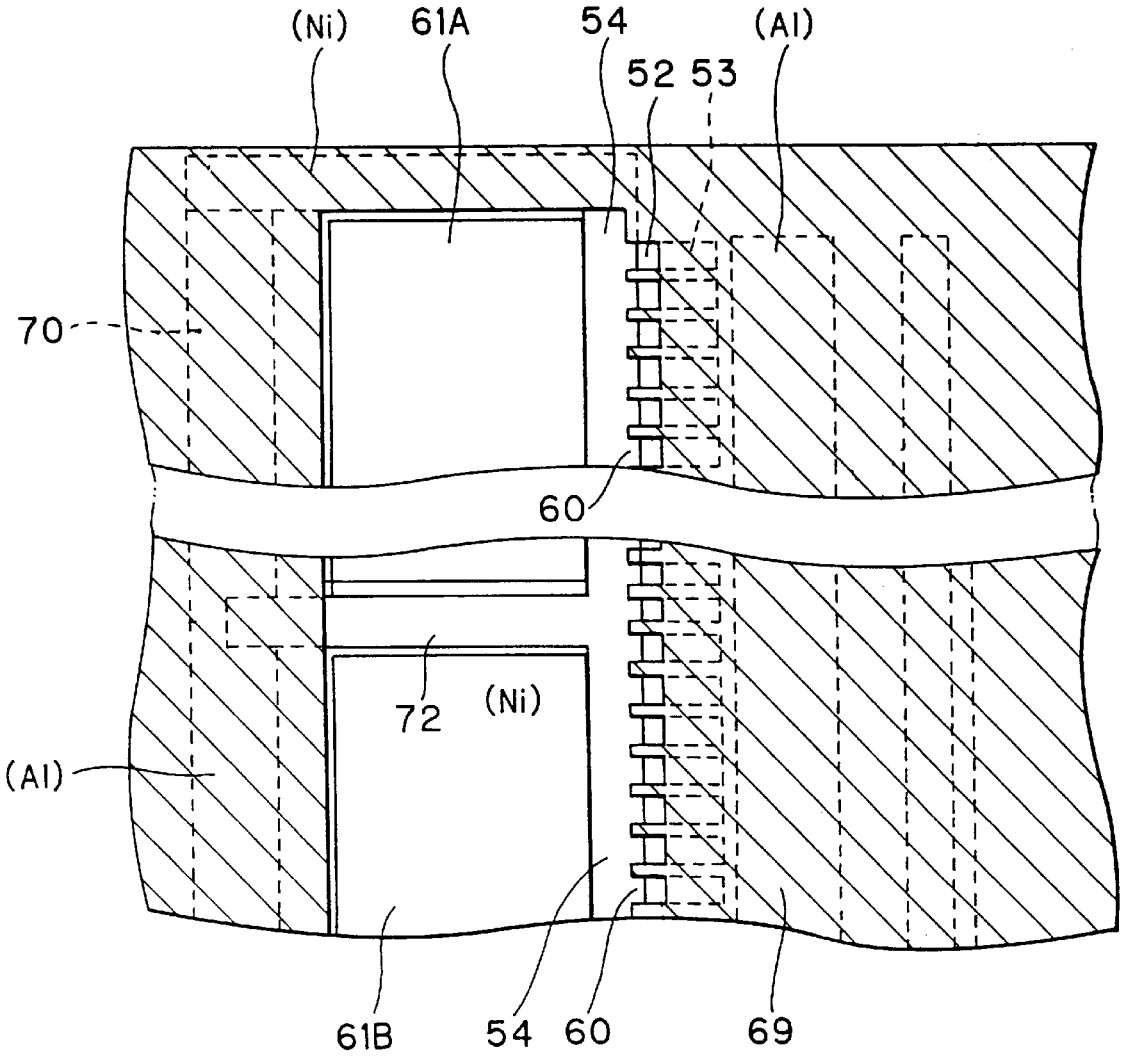
FIG. 4 is a cross-sectional view cut along a line IV—IV shown in FIG. 3 illustrating a first embodiment of the present invention.
Figure 5:
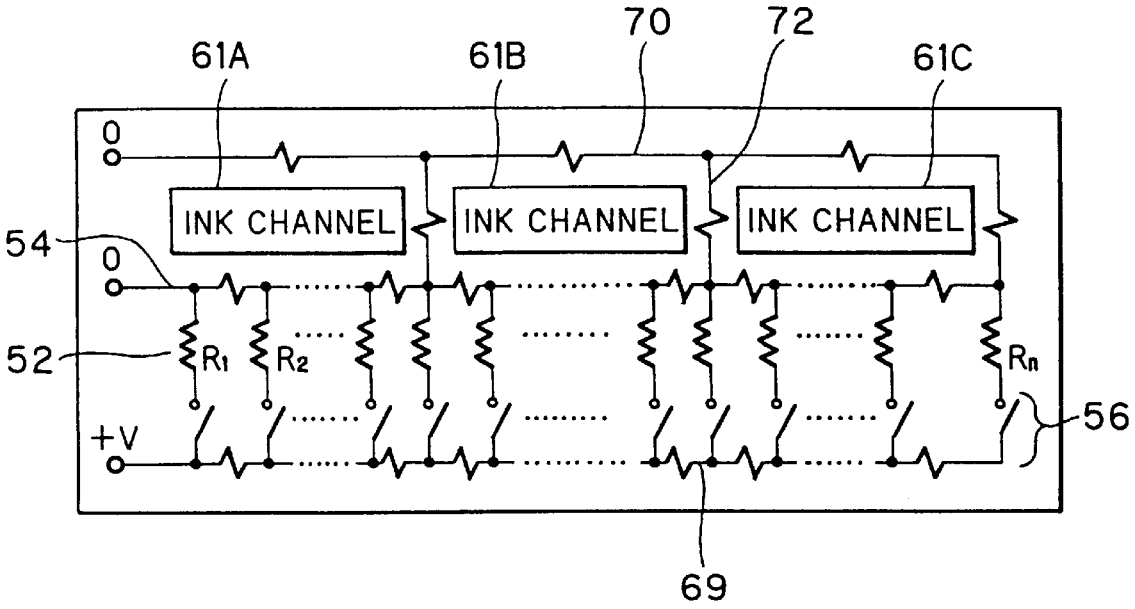
FIG. 5 is a conceptional explanatory diagram illustrating a connection of a bypass common line to a heater ladder.

A first embodiment of the present invention will be described with reference to FIGS. 2 through 5. FIG. 2 is a cross-sectional view showing an ink jet printer to which the first embodiment of the present invention is applied. FIG. 3 is a cross-sectional view showing an ink jet recording head used in the ink jet printer shown in FIG. 2. FIG. 4 is a cross-sectional view cut along the line IV—IV shown in FIG. 3. FIG. 5 shows a conceptional diagram showing a connection of a heater ladder, a nickel common conductor line, and an aluminum bypass conductor line.

As shown in FIG. 2, a recording sheet 20 is heated by a belt-type preheater 27. A suction transport unit 28 transports the heated recording sheet 20 at a predetermined speed under a full-color line head 1. An image is printed on the recording sheet 20 by ejecting four different colors of ink from the four rows of nozzles aligned in the full-color line head 1. Four colors of ink are supplied into ink supply ports formed in a frame 2. As shown in FIG. 3, each ink supply port is in fluid communication with a common ink reservoir 63 formed in the frame 2, a connection hole 62, a common ink channel 61 formed in a silicon substrate 51, individual ink channels 60, and orifices or ejection nozzles 59 formed in an orifice plate 58. The individual ink channels 60 are formed corresponding to respective ones of the ejection nozzles 59 individually. The ink is ejected from the ejection nozzles 59 when the corresponding heater is applied with a voltage by an LSI driver circuit to be described later. Each nozzle ejects ink droplets in a direction substantially perpendicular to the surface of the heater resistor.

A total of 1680 nozzles 59 are aligned for each color at a pitch of, for example, 62.5 $\mu$m (400 dpi) in the direction perpendicular to the surface of the sheet on which FIG. 3 is printed. This amounts to a total of 6720 nozzles provided in the single substrate of the full-color line hand 1. The symmetrical full-color line head 1 is produced from two substrates aligned in a straight line on the same frame 2. Abutting ends of the two substrates are connected at the central portion of the frame 2 by die bonding.

A Ta—Si—SiO alloy thin-film resistor layer and a nickel thin-film conductor layer are formed on the silicon substrate 51 by sputtering. As shown in FIG. 4, a plurality of thin-film heater resistors 52, a plurality of individual thin-film conductors 53, and a common thin-film conductor line 54 are formed by photo-etching on the silicon substrate 51. The common thin-film conductor line 54 is connected commonly to one side of the thin-film heater resistors 52, and the plurality of individual thin-film conductors 53 are connected to an opposite side of the heater resistors 52 so that the conductors 53 are connected to the respective ones of the heater resistors 52 individually. Also, the LSI driver circuit 56 for driving the heater resistors 52 is formed on the same silicon substrate 51. The driver circuit 56 is connected to the conductors 53 through a through-hole.

The individual thin-film conductors 53 and the common thin-film conductor 54 are both formed from 1 $\mu$m thick nickel (Ni) thin film. Neither of them are covered with protection layers. The LSI driver circuit 56, which is constructed from a shift register and a driver circuit, is driven by drive signals inputted from an external device.

The circuit configuration shown in FIG. 5 conceptionally shows a connection of a bypass common conductor line 70 to the thin-film common conductor 54 according to the first embodiment. At least one connection line 72, three in the embodiment shown in FIG. 5, connects the bypass common conductor line 70 to the common conductor line 54. The connection lines 72 are connected to the common conductor line 54 through through-holes. The bypass common conductor line 70 is provided to reduce the resistance value of the common thin-film conductor 54. The bypass common conductor line 70 is made from aluminum. The connection line 72 and the common conductor line 54 are made from nickel to have substantially the same resistance value per a unit of length. Therefore, the resistance value of the bypass common conductor line 70 is lower than that of the common conductor line 54 or the connection line 72.

In one example, the common ink channel 61 is divided into a predetermined number of common ink channel segments, three (61A, 61B and 61C) in the example shown in FIG. 5, to form the bypass common conductor line 70 in one side of the common ink channel segments 61A, 61B and 61C remote from the driver circuit 56 and also to preserve paths of the connection lines 72 between two adjacent common ink channel segments. The n-number of heater resistors 52 are also divided into a predetermined number of groups corresponding to the number of common ink channel segments as divided. The individual ink channels corresponding to the heater resistors 52 in each of the divided groups are supplied with ink from the corresponding common ink channel segment.

In another example, the common ink channel 61 is not divided and the bypass common conductor line 70 is formed in a vicinity of the driver circuit 56. Specifically, the bypass common conductor line 70 may be formed directly above the driver circuit 56 with a dielectric layer formed therebetween. Alternatively, the bypass common conductor line 70 may be formed in such a manner that a part of the bypass common conductor line 70 is formed above the driver circuit 56 and also above the side marginal area of the driver circuit 56 at the side remote from the driver circuit 56. In the latter case, the bypass common conductor line 70 is formed above a dielectric layer so as to be electrically insulated from the driver circuit 56.

In the circuit configuration shown in FIG. 5, when the number of heater resistors n is equal to 512 (n=512) and this number is divided into two groups so that each group contains 256 heater resistors, the temperature of the 400-th heater resistor $R_{400}$ (n=400) was minimum (300° C.) among others and the temperature of the first heater resistor $R_1$ (n=1) was maximum (335° C.). Therefore, the maximum temperature difference is 35° C. In this case, the resistance values of all thin-film heater resistors R1 through $R_{512}$ are 200 Ω.

Figure 1:
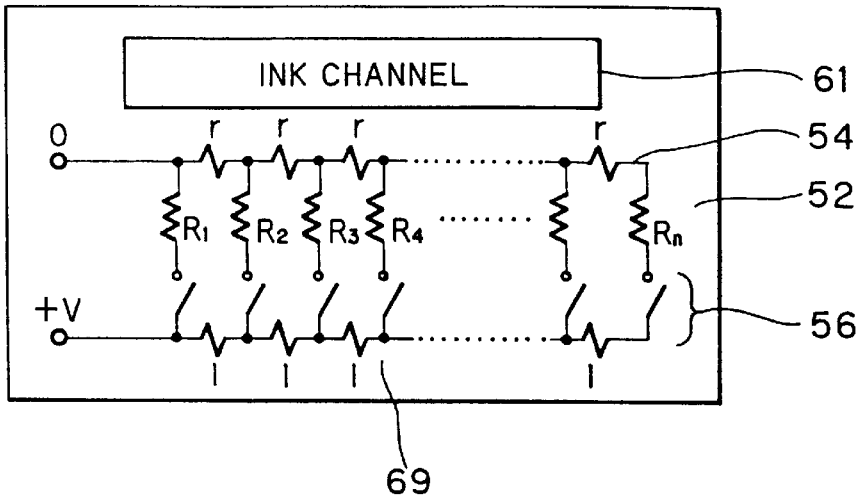
FIG. 1 PRIOR ART
FIG. 1 is a conceptional explanatory diagram illustrating a connection of a heater ladder to a driver circuit according to a prior art system.

In the conventional head as shown in FIG. 1, with the head having 256 heater resistors (n=256), the maximum temperature difference was 68° C. In the first embodiment of the present invention, the maximum temperature difference was 35° C. notwithstanding the fact that the number of the heater resistors is twice as large as in the conventional head.

When n=1024 or more, the aluminum line is not usable for the bypass common line conductor 70 because the maximum temperature difference between two of 1024 heater resistors becomes above 67° C. However, the temperature difference can be greatly reduced by replacing the 200 $\mu$m wide aluminum line with a 800 $\mu$m wide aluminum line. For example, when an A4 size line head having 1680 heater resistors 52 (n=1680) is divided into eight groups and the common ink channel 61 is also divided into eight segments, the heater in a position around n=157 generates a minimum amount of heat and its temperature becomes 300° C. and the heater in a position around n=1 generates a maximum amount of heat and its temperature becomes 335° C. Thus, the heater resistors will not be thermally cut. Test printing proved that the printer using such a recording head is reliably operable even after one million dots were printed.

In the above-described embodiment where n=1680, the maximum difference of the heat generating temperatures can be reduced 35° C. by using 0.8 mm wide aluminum line in the bypass common line conductor 70. However, a problem with the above embodiment is that the line head cannot be made compact because the width of more than 0.8 mm×2 is occupied by a power source line 69 and the aluminum line for the bypass common conductor line 70. The following modification solves this problem. Like the first embodiment, the head includes 1680 heater resistors and is divided into eight groups. The common ink channel 61 is also divided into eight common ink channel segments 61A through 61H. In the modification, the width of the aluminum line is reduced to 400 $\mu$m. The resistance values of the heater resistors are made different by 4 Ω on a group basis starting from the resistance value of 200 Ω. Specifically, the resistance value R(61A) of each of the heater resistors belonging to a first group that corresponds to the first divided common ink channel 61A is 200 Ω, and the resistance value R(61B) of each of the heater resistors belonging to a second group that corresponds to the second divided common ink channel 61B is 196 Ω. In this manner, the resistance value R(61H) of each of the heater resistors belonging to an eighth group that corresponds to the eighth divided common ink channel 61H is 172 Ω. The resistance value can be reduced 4 Ω by increasing the width of the heater 1% and reducing the length 1%. Also it is confirmed that ink ejection is not affected by the variety of the heater resistors to this extent.

With the resistance values of the heater resistors as determined above, the temperature of each heater resistor can be computed based on the electric power applied to the heater resistors. A heater resistor positioned at a center portion of each group will have a low temperature. A heater resistor positioned at around n=1581 that belongs to the eighth group will have the minimum temperature. The first heater resistor of each of eight groups will have a high temperature. A heater resistor positioned at n=1 that belongs to the first group will have the maximum temperature. When an electric power determined by a pulse duration is applied to the 1581-th heater resistor so that its temperature becomes 300° C., the heater resistor at n=1 becomes 320° C. That is, all 1681 heater resistors can be driven at temperatures ranging from 300° C. to 320° C. Taking into consideration the variation in the resistance values of the heater resistors caused at the time of manufacture, the actual temperature range would be 320° C.+/−20° C. Nevertheless, there were no defects in the printed results after printing one million dots.

The resistance value to be reduced for each group of the heater resistors can be determined so that the first heater resistor in each group is increased to the same temperature. Also, the shapes of the heater resistors must be determined so as not to affect ink ejection efficiency and the nozzle density design.

In the above-described example, the change in the shape of the heater resistor is about 7% at maximum with the use of 400 μm aluminum line. If the width of the aluminum line is further reduced to 200 μm, the resistance value of the heater resistors belonging to the eighth group needs to be 133 Ω. To do so, the length and the width of the heater resistors belonging to the eighth group must be shortened 20% with respect to those of the 133 Ω heater resistors belonging to the first group. This reduces the nozzle density and thus is not desirable.

As described above, the ink jet recording head of the first embodiment of the present invention can generate uniformly distributed heat along the lengthwise direction of the head. Therefore, the print quality can be improved.

Figure 6:
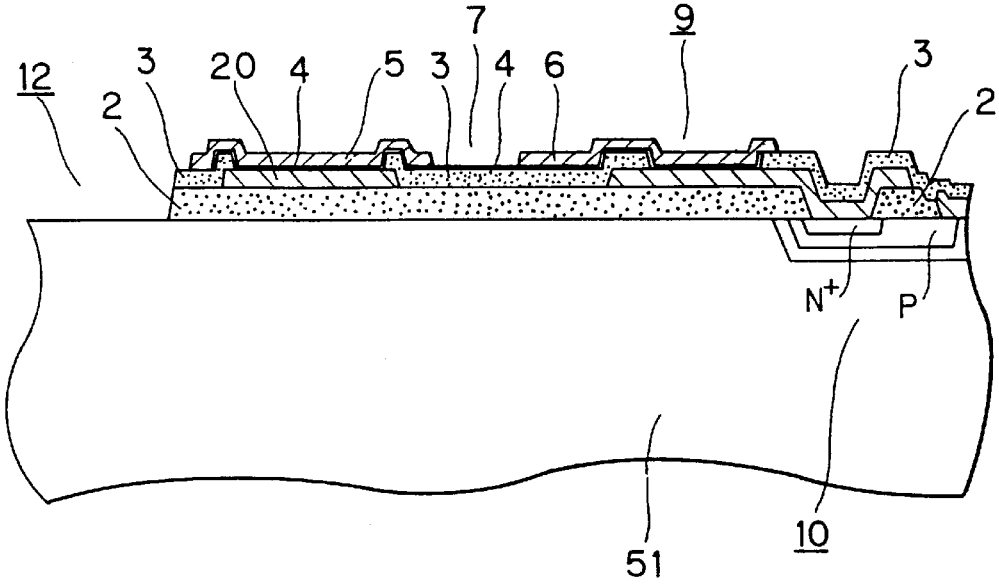
FIG. 6 is a cross-sectional view out along a line VI—VI shown in FIG. 11 illustrating a second embodiment of the present invention.
Figures 7A, 7B, 7C, 7D:
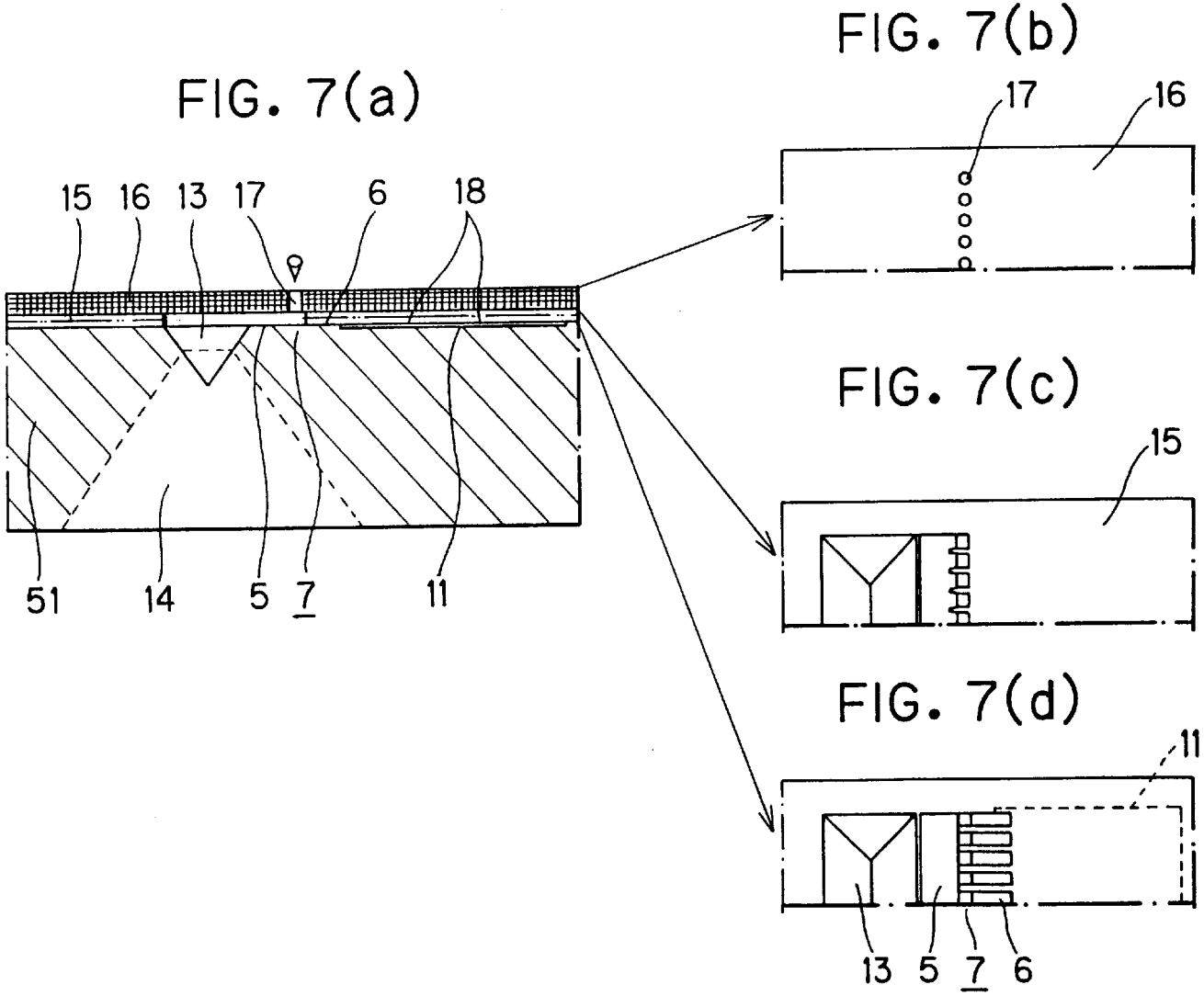
FIG. 7(*a*) is a cross-sectional view showing a nozzle portion of the ink jet recording head according to the second embodiment of the present invention.
Figure 8:
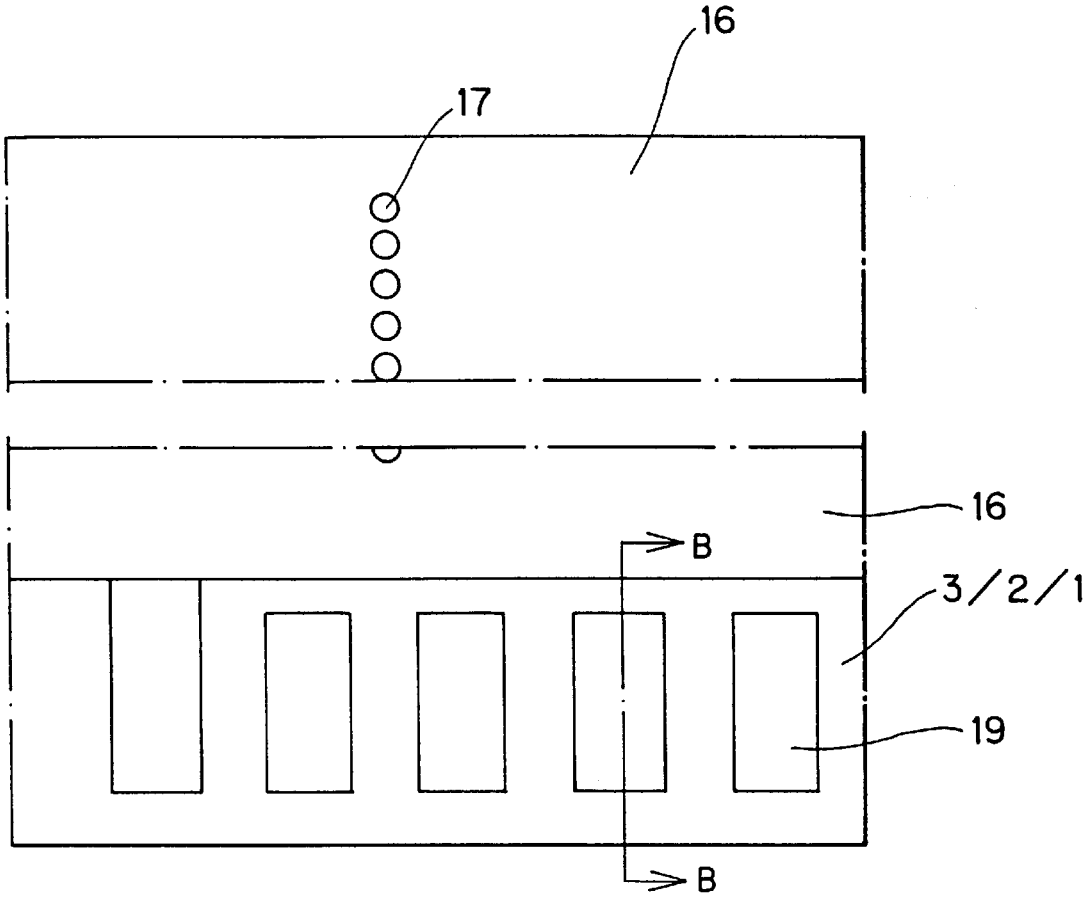
FIG. 8 is a plan view showing the ink jet print head according to the second embodiment of the present invention as viewed from the side of orifice plate.

A second embodiment of the present invention will be described with reference to FIGS. 6 through 11. FIG. 6 is a cross-sectional, view of the ink jet recording head of the second embodiment. FIG. 7(*a*) is a cross-sectional view showing a structure of a nozzle in the ink ejection recording head of, for example, 400 dpi. FIGS. 7(*b*) and 8 are plan views showing the ink ejection recording head as viewed from an orifice plate 16. FIG. 8 shows an overall structure of the recording head and FIG. 7(*b*) shown a part of it. FIG. 7(*c*) is a plan view showing the recording head with omitted orifice plate 16. FIG. 7(*d*) is also a plan view showing the recording head with a partition wall 15 and the orifice plate 16 omitted.

A plurality of heater resistors 7 are connected to a common conductor line 5 and individual conductor lines 6 both made from nickel thin-film. Each of the individual conductor lines 6 is connected to a driving LSI transistor 10 of an LSI driving circuit 11 through a through-hole 9. Ink channels 13 are not yet formed in the silicon substrate shown in FIG. 6.

The driving circuit 11 includes a shift register and a latch circuit in addition to the driving transistors 10. These components of the driving circuit 11 are connected to an LSI aluminum conductor line 18. A bonding pad 19 shown in FIG. 8 forms a terminal portion for inputting voltage signals to the aluminum conductor line 18 from an external circuit. One of the terminal portions is connected to the common conductor line 5 and the other to the aluminum conductor line 18 covered with a passivation silicon nitride film 3.

The ink supplied from an ink supply port 14 fills the ink channel 13 and is ejected in response to a driving signal from the nozzle 17 through the common ink channel on the common conductor line 5 and the individual ink channel containing therein the heater resistor.

Figure 9:
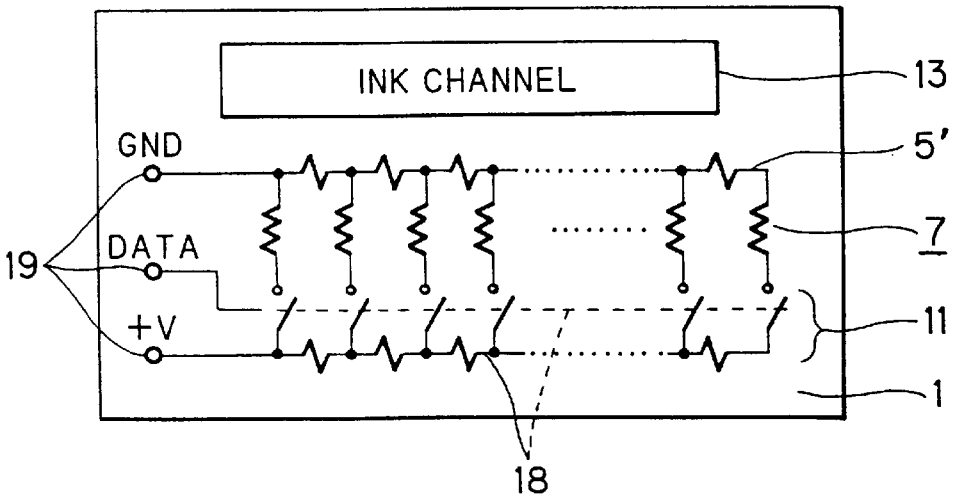
FIG. 9 is a conceptional explanatory diagram illustrating a connection of an LSI driving circuit to a heater ladder.

FIG. 9 is a conceptional explanatory diagram illustrating a connection of the driver circuit to a heater ladder according to the second embodiment of the present invention. In this embodiment, the common conductor line 5' connected to ground is formed by an aluminum thin-film layer 20 (first layer), a Ta—Si—O alloy thin-film layer (second layer) 4 deposited on the first layer 20, and a nickel thin-film layer (third layer) 5 deposited on the second layer 4. With the use of the common conductor line of a three-layer structure, the resistance value of the common conductor line can be reduced to 2.8 μ/cm. In this connection, a conventionally used common conductor line made of nickel has a resistance value of 15 Ω/cm. Therefore, it is possible to manufacture, for example, a 1600 dpi, A4 size full color line head using the three-layer structure common conductor line 51'.

A manufacturing method of the recording head will next be described while referring to FIG. 6.

Figure 10:
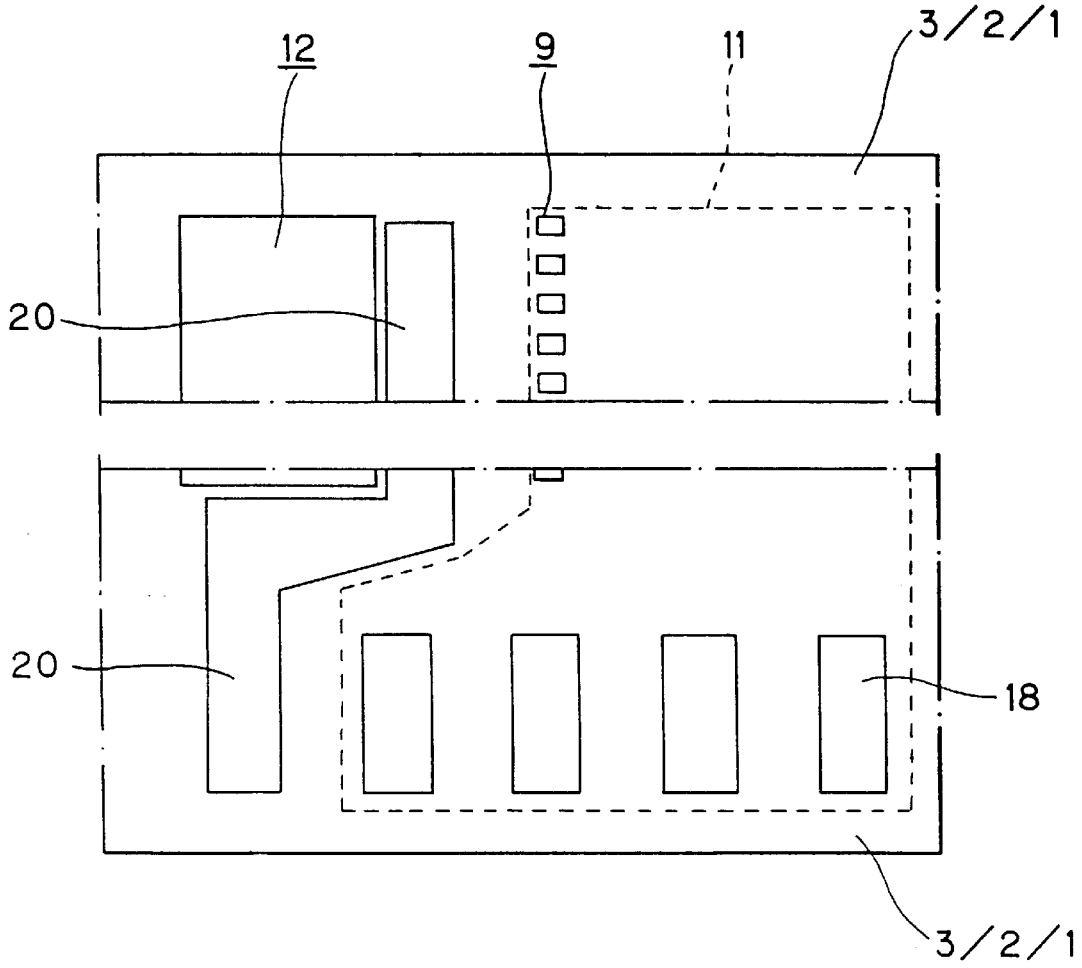
FIG. 10 is a plan view showing a silicon substrate of the ink jet recording head according to the second embodiment of the present invention on which the heater ladder is to be deposited.

In an aluminum layer deposition step that is a final step of the LSI driving circuit forming procedure, the aluminum thin-film layer 20 is deposited. Above the layer 20, a passivation plasma silicon nitride layer 3 is deposited. Through-holes 9 for the individual conductor lines and, through-holes 21 for bonding pads are formed by photo-etching. Also, the silicon nitride layer 3 is removed by photo-etching except for the peripheral portion of the aluminum thin-film layer 20 to form a through-hole 22. A plan view of the silicon substrate 51 in this condition is shown in FIG. 10. The bottom surfaces of the respective through-holes 9, 21 and 22 are formed with an aluminum thin-film layer, and the bottom surface of the ink channel forming portion 12 is formed with a $SiO_2$ layer.

Figure 11:
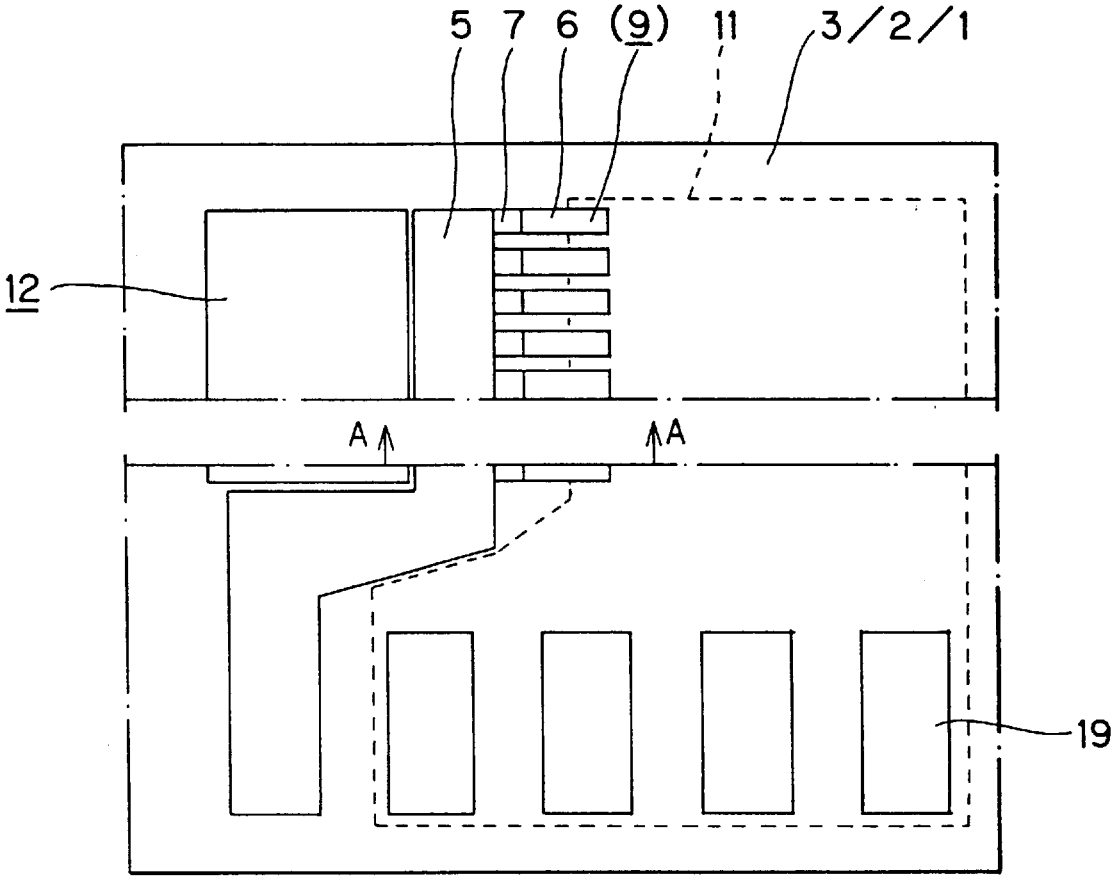
FIG. 11 is a plan view showing the silicon substrate of the ink jet recording head according to the second embodiment of the present invention on which the heater ladder has been deposited.

Thereafter, the $SiO_2$ layer in the ink channel forming portion 12 is removed, and the Ta—Si—O alloy thin-film layer and the nickel thin-film layer are successively deposited one on the other by sputtering. The heater resistors 7, the common conductor line 5, individual conductor lines 6 and the bonding pad 19 are formed by photo-etching. The common conductor line 5, the individual conductor lines 6 and the bonding pad 19 are formed by about 1 μm thick nickel thin-film layer. Beneath the nickel thin-film layer 5, about 0.1 μ thick Ta—Si—O alloy thin-film layer 4 is deposited which is connected through the through-hole 21 to the aluminum thin-film layer 20 deposited beneath the Ta—Si—O alloy thin-film layer 4. The plan view of the silicon substrate in this condition is shown in FIG. 11.

As described, the aluminum thin-film layer 20 is perfectly covered with the silicon nitride layer 3, the Ta—Si—O alloy thin-film layer 4 and the nickel thin-film layer 5. Therefore, the aluminum thin-film layer 20 is prevented from being attacked. Furthermore, the resistance value of this three-layer structure is lowered to ⅕ to ⅙ with respect to the nickel thin-film layer 5 due to the provision of a low resistance aluminum thin-film layer 20.

Figure 12:
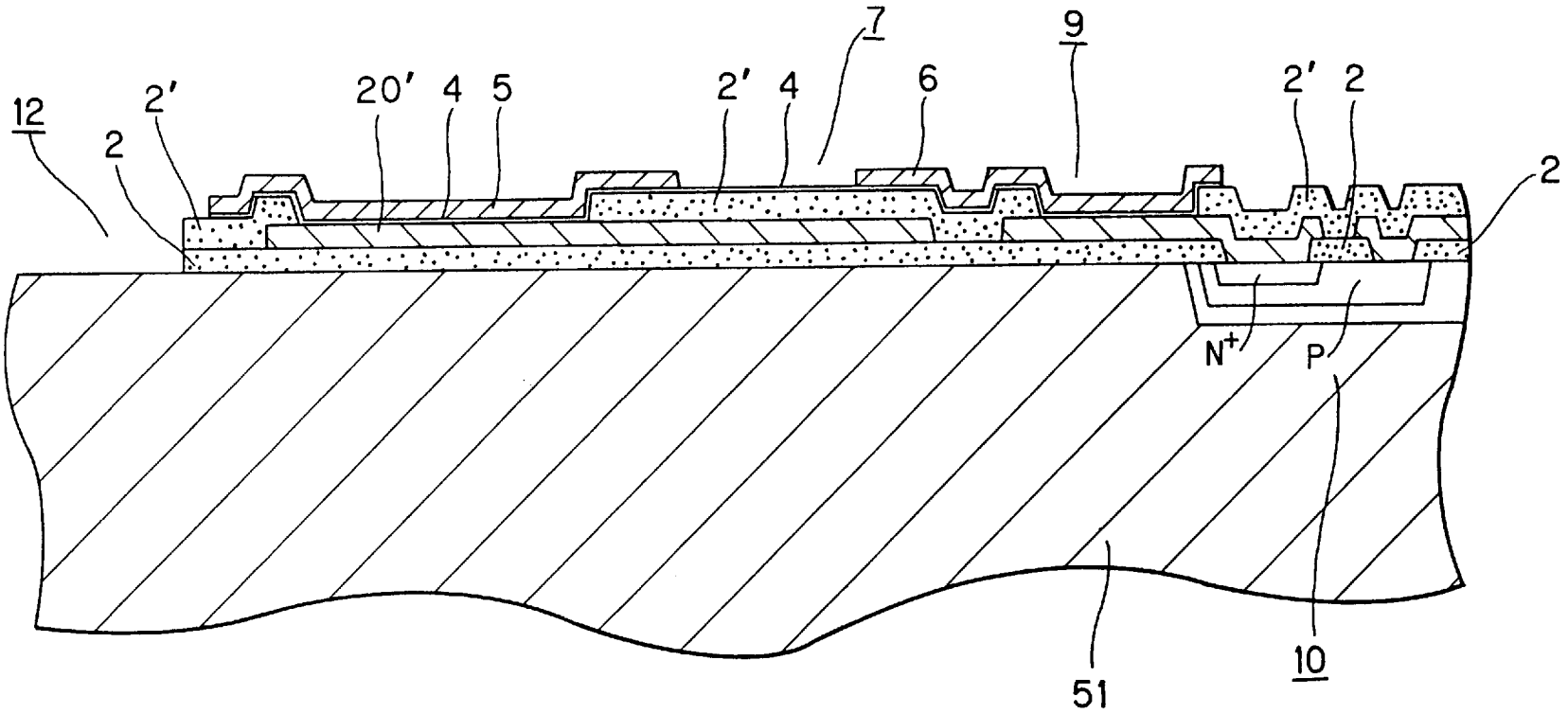
FIG. 12 is a cross-sectional view showing an ink jet recording head according to a modification of the second embodiment of the present invention.

A modification of the second embodiment is shown in FIG. 12. In this modification, the aluminum thin-film layer 20' extends beneath the heater resistors 7. Above the aluminum thin-film layer 20', a $SiO_2$ layer 2' of 1 to 1.5 μm thickness is formed to provide a thermally insulating layer. Although not shown in FIG. 12, a silicon nitride layer may be deposited on the $SiO_2$ layer 2' that is excellent in passivation characteristic. In this modification, the width of the aluminum thin-film layer 20' is about 250 μm and the resistance value of the three-layer structure common conductor line is 1 Ω or less.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An ink jet recording head comprising:

a silicon substrate having a surface;

a plurality of heaters, formed on the surface of said silicon substrate, comprising a plurality of thin-film resistors and a plurality of thin-film conductors provided to respective ones of said plurality of thin-film resistors individually;

a driver circuit formed in the surface of said silicon substrate and connected to said plurality of thin-film resistors through said plurality of thin-film conductors, respectively, said driver circuit selectively driving said plurality of heaters;

a plurality of partition walls formed on the surface of said silicon substrate and defining a plurality of individual ink channels corresponding to respective ones of said plurality of heaters individually;

an orifice plate disposed on said plurality of partition walls and formed with a plurality of orifices corresponding to respective ones of said plurality of individual ink channels individually;

a common ink channel in fluid communication with said plurality of individual ink channels, said common ink channel having a first side and a second side;

a first connection line commonly connecting said plurality of thin-film resistors;

a common terminal connected to said first connection line, said first connection line having a resistance value per a unit length, wherein said plurality of heaters and said first connection line are formed in said first side of said common ink channel;

a bypass common line provided in said second side opposite the first side with respect to said common ink channel, said bypass common line having a resistance value per a unit length that is lower than the resistance value of said first connection line; and at least one second connection line connecting said bypass common line to said first connection line.

2. The ink jet recording head according to claim 1, wherein said at least one second connection line has a resistance value per a unit of length that is substantially equal to the resistance value of said first connection line.

3. The ink jet recording head according to claim 2, wherein said first connection line and said at least one second connection line are made from nickel, and said bypass common line is made from aluminum.

4. The ink jet recording head according to claim 3, wherein said plurality of thin-film resistors are made from a Ta—Si—SiO alloy.

5. The ink jet recording head according to claim 1, wherein said common ink channel is divided into a predetermined number of common ink channel segments, and said plurality of heaters are divided into a predetermined number of groups corresponding to said predetermined number of common ink channel segments, each of said predetermined number of groups containing a predetermined number of heaters, wherein individual ink channels corresponding to said predetermined number of heaters contained in each of said predetermined number of groups are in fluid communication with a corresponding one of said predetermined number of common ink channel segments, and wherein said at least one second connection line extends between adjacent two common ink channel segments.

6. The ink jet recording head according to claim 5, wherein said predetermined number of heaters contained in each of said predetermined number of groups have resistance values substantially equal to one another when said plurality of heaters are divided into a first predetermined number of groups of heaters.

7. The ink jet recording head according to claim 6, wherein said predetermined number of heaters contained in each of said predetermined number of groups have such resistance values that said predetermined number of heaters generate an amount of heat substantially equal to one another when said plurality of heaters are divided into a second predetermined number of groups of heaters.

8. The ink jet recording head according to claim 7, wherein said second predetermined number of groups of heaters is greater than said first predetermined number of groups of heaters.

9. An ink jet recording head comprising:

a silicon substrate having a surface;

a plurality of heaters formed on the surface of said silicon substrate and having a plurality of thin-film resistors and a plurality of thin-film conductors provided to respective ones of said plurality of thin-film resistors individually;

a driver circuit formed in the surface of said silicon substrate and connected to said plurality of thin-film resistors through said plurality of thin-film conductors, respectively, said driver circuit selectively driving said plurality of heaters;

a plurality of partition walls formed on the surface of said silicon substrate and defining a plurality of individual ink channels corresponding to respective ones of said plurality of heaters individually;

an orifice plate disposed on said plurality of partition walls and formed with a plurality of orifices corresponding to respective ones of said plurality of individual ink channels individually;

a common ink channel in fluid communication with said plurality of individual ink channels, said common ink channel having a first side and a second side;

a first connection line commonly connecting said plurality of thin-film resistors;

a common terminal connected to said first connection line, said first connection line having a resistance value per a unit length, wherein said plurality of heaters and said first connection line are formed at one side of said common ink channel remote from said driver circuit;

a bypass common line provided in a vicinity of said driver circuit, said bypass common line having a resistance value per a unit length that is lower than the resistance value of said first connection line; and at least one second connection line connecting said bypass common line to said first connection line.

10. The ink jet recording head according to claim 9, wherein said at least one second connection line has a resistance value per a unit of length that is substantially equal to the resistance value of said first connection line.

11. The ink jet recording head according to claim 10, wherein said first connection line and said at least one second connection line are made from nickel, and said bypass common line is made from aluminum.

12. The ink jet recording head according to claim 11, wherein said plurality of thin-film resistors are made from a Ta—Si—SiO alloy.

13. The ink jet recording head according to claim 9, wherein said common ink channel is divided into a predetermined number of common ink channel segments, and said plurality of heaters are divided into a predetermined number of groups corresponding to said predetermined number of common ink channel segments, each of said predetermined number of groups containing a predetermined number of heaters, wherein individual ink channels corresponding to said predetermined number of heaters contained in each of said predetermined number of groups are in fluid communication with a corresponding one of said predetermined number of common ink channel segments, and wherein said at least one second connection line extends between adjacent two common ink channel segments.

14. The ink jet recording head according to claim 13, wherein said predetermined number of heaters contained in each of said predetermined number of groups have resistance values substantially equal to one another when said plurality of heaters are divided into a first predetermined number of groups of heaters.

15. The ink jet recording head according to claim 14, wherein said predetermined number of heaters contained in each of said predetermined number of groups have such resistance values that said predetermined number of heaters generate an amount of heat substantially equal to one another when said plurality of heaters are divided by a second predetermined number of groups of heaters.

16. The ink jet recording head according to claim 15, wherein said second predetermined number of groups of heaters is greater than said first predetermined number of groups of heaters.

17. An ink jet recording head comprising:

a silicon substrate having a surface;

a plurality of heaters formed on the surface of said silicon substrate and comprising a plurality of thin-film resistors and a plurality of thin-film conductors provided to respective ones of said plurality of thin-film resistors individually;

a driver circuit formed in the surface of said silicon substrate and connected to said plurality of thin-film resistors through said plurality of thin-film conductors, respectively, said driver circuit selectively driving said plurality of heaters;

a plurality of partition walls formed on the surface of said silicon substrate and defining a plurality of individual ink channels corresponding to respective ones of said plurality of heaters individually;

an orifice plate disposed on said plurality of partition walls and formed with a plurality of orifices corresponding to respective ones of said plurality of individual ink channels individually;

a common ink channel in fluid communication with said plurality of individual ink channels, said common ink channel having a first side and second side;

a first connection line commonly connecting said plurality of thin-film resistors;

a common terminal connected to said first connection line, said connection line comprising a three-layer structure including an aluminum thin-layer, Ta—Si—O alloy thin-film layer deposited to cover said aluminum thin-layer, and a nickel thin-film layer deposited on said Ta—Si—O alloy thin-film layer, said first connection line having a resistance value per a unit length, wherein said plurality of heaters and said first connection line are formed in said first side of said common ink channel;

a bypass common line provided in said second side opposite the first with respect to said common ink channel, said bypass common line having a resistance value per a unit length that is lower than the resistance value of said first connection line; and at least one second connection line connecting said bypass common line to said first connection line.

18. The ink jet recording head according to claim 17, wherein said first connection line is formed in a position opposite said driving circuit with respect to said plurality of heaters.

19. The ink jet recording head according to claim 17, wherein said Ta—Si—O alloy thin-film layer extends below said plurality of heaters.

20. The ink jet recording head according to claim 19, further comprising a heat insulating layer deposited on said aluminum thin-film layer.

* * * * *